US009873596B2

(12) United States Patent
Dorzbach et al.

(10) Patent No.: US 9,873,596 B2
(45) Date of Patent: Jan. 23, 2018

(54) ELECTRO-HYDRAULIC DEVICE FOR MOVING A JIB

(71) Applicant: WOLFFKRAN HOLDING AG, Zug (CH)

(72) Inventors: Ulrich Dorzbach, Heilbronn (DE); Andreas Wagner, Talheim (DE)

(73) Assignee: WOLFFKRAN HOLDING AG, Zug (CH)

( * ) Notice: Subject to any disclaimer, the term of this patent is extended or adjusted under 35 U.S.C. 154(b) by 75 days.

(21) Appl. No.: 14/403,407

(22) PCT Filed: May 16, 2013

(86) PCT No.: PCT/EP2013/060181

§ 371 (c)(1),
(2) Date: Nov. 24, 2014

(87) PCT Pub. No.: WO2013/178480

PCT Pub. Date: Dec. 5, 2013

(65) Prior Publication Data

US 2015/0203335 A1 Jul. 23, 2015

(30) Foreign Application Priority Data

May 31, 2012 (DE) ..... 10 2012 010 759

(51) Int. Cl.

| | |
|---|---|
| ***B66C 13/30*** | (2006.01) |
| ***B66C 23/06*** | (2006.01) |
| ***B66C 23/82*** | (2006.01) |
| ***B66C 23/86*** | (2006.01) |
| ***B66C 13/18*** | (2006.01) |

(52) U.S. Cl.

CPC ..... *B66C 13/30* (2013.01); *B66C 13/18* (2013.01); *B66C 23/06* (2013.01); *B66C 23/82* (2013.01); *B66C 23/86* (2013.01)

(58) Field of Classification Search

USPC ..... 212/276

See application file for complete search history.

(56) References Cited

U.S. PATENT DOCUMENTS

| | | | | |
|---|---|---|---|---|
| 7,552,350 | B2 * | 6/2009 | Fung | G06F 1/32 713/320 |
| 2009/0249712 | A1 * | 10/2009 | Brickell | A62B 1/10 52/173.1 |
| 2010/0006530 | A1 | 1/2010 | Juraszek | |
| 2010/0156180 | A1 * | 6/2010 | Nishiyama | H02J 7/345 307/46 |
| 2010/0225263 | A1 * | 9/2010 | Mishima | H02P 7/29 318/430 |
| 2012/0305513 | A1 * | 12/2012 | Muller | B66C 13/28 212/284 |

FOREIGN PATENT DOCUMENTS

| | | | | |
|---|---|---|---|---|
| DE | 1 835 976 | U | 8/1961 | |
| DE | 10 2010 008155 | A1 | 8/2011 | |
| EP | 1 031 531 | A2 | 8/2008 | |
| EP | 2377802 | A1 | 10/2011 | |
| WO | WO 2011098542 | A1 * | 8/2011 | B66C 13/28 |

OTHER PUBLICATIONS

International Search Report issued in application No. PCT/EP2013/060181 dated Aug. 12, 2013.

* cited by examiner

*Primary Examiner* — Kawing Chan

(74) *Attorney, Agent, or Firm* — Potomac Law Group, PLLC

(57) ABSTRACT

The invention relates to an electro-hydraulic device for moving a jib for a tower crane, in which device the motor of the hydraulic unit is switched off when the position of the jib is not altered for a predetermined time period.

8 Claims, No Drawings

ELECTRO-HYDRAULIC DEVICE FOR MOVING A JIB

The invention relates to an electro-hydraulic device for moving a jib and to a tower crane having a luffing jib with a device of this type.

In tower cranes having a luffing jib, the movement of the jib in the vertical direction can take place via a hydraulic cylinder which is retracted or extended in order to achieve the desired spacing between the crane axis and the rope axis. Here, a hydraulic assembly, comprising an oil pump, provides the oil quantity which is required for force transmission at the required pressure.

When the jib has reached the desired angle, that is to say further retraction or extension is first of all no longer required, changing oil quantity or changing oil pressure is not required any more at the hydraulic cylinder. After the movement has stopped, the hydraulic assembly continues to deliver only as much oil as is required to maintain the pressure. In this operating state, the electric motor which drives the hydraulic assembly is running virtually at idling speed.

In a tower crane with a hydraulically movable luffing jib, the motor which drives the hydraulic assembly is usually a three-phase asynchronous motor.

However, a three-phase asynchronous motor which is running at idling speed has a very poor performance factor and degree of efficiency. During the idling phase, the three-phase asynchronous motor continues to consume energy. A large part of said energy consumption, approximately about 60%, is unnecessary; the energy is consumed merely in order to deliver the oil in an empty manner in the circuit, but not for the work of the hydraulic cylinder. A reduction in the energy consumption is desirable for cost and environmental reasons.

In addition, the noise caused by the hydraulic assembly at idling speed is only negligibly lower than in the normal operating state.

It was therefore an object to provide an electro-hydraulic device for moving a jib for a tower crane, in which electro-hydraulic device the energy consumption for the jib movement and the development of noise are reduced.

This object is achieved by way of an electro-hydraulic device for moving a jib as claimed in claim 1.

Furthermore, the object is achieved by way of a luffing jib tower crane as claimed in claim 4.

Further embodiments are the subject matter of the sub-claims or are described in the following text.

The electro-hydraulic device according to the invention for moving a jib brings about time-delayed switching off of the motor if no changing oil pressure is required at the hydraulic cylinder for a predefined time period (=delay time). If, in contrast, only a very short interruption of the movement sequence takes place, for example when a load is being positioned, the motor is usually not switched off.

Switching on the motor again and running up always likewise require a certain time, with the result that consideration has to be taken of whether the interruption is long enough to give preference to the saving of energy over the delay in movement which is disruptive for the crane driver. The delay time is set in a corresponding manner.

It is particularly advantageous if the time which switching on again and running up of the motor takes is kept low by way of an optimized electric or electronic starting circuit. The delay time can then be selected to be all the shorter; the energy saving is also improved in this way. In particular, the motor can also start by way of an electronic soft starting unit.

The delay time can preferably be set as desired in the case of an electro-hydraulic jib movement according to the invention.

If the position of the jib is to be changed again, the motor is switched on again upon actuation of the operating elements for the jib.

The working time of a crane per year can be estimated at 260 days times 10 hours which equals 2600 hours. The interval times of a luffing gear should be on average approximately 60.%, that is to say 1560 hours. If it is assumed, for example, that the idling losses are 1.1 kW in the case of a nominal power of 22 kW, the energy saving in this example is 1700 kWh per year.

The system can be provided in such a way that restarting of the motor is brought about not only by way of an initiated change in the jib angle, but rather also by way of any other desired crane movements, for example of the lifting gear or the slewing gear.

The invention claimed is:

1. An electro-hydraulic device for moving a jib of a luffing jib tower crane, comprising a three-phase asynchronous motor and operating elements for changing the vertical position of the jib, a lifting gear, or a slewing gear, wherein the motor is configured to switch off if the position of the jib is not changed for a predefined time period, and wherein the motor is configured to switch on again if an operating element is actuated.

2. The electro-hydraulic device of claim 1, wherein the motor is configured to switch on again if an operating element for changing the vertical position of the jib, a lifting gear, or a slewing gear is actuated.

3. The electro-hydraulic device of claim 1, wherein the motor is operably connected to an electronic soft starting unit.

4. A luffing jib tower crane, comprising the electro-hydraulic device of claim 1.

5. The method of claim 2, wherein the motor is switched on when an operating element for changing the vertical position of the jib is actuated.

6. The method of claim 2, wherein the motor is switched on when an operating element for a lifting gear or a slewing gear is actuated.

7. A method for reducing energy consumption in a three-phase asynchronous motor of an electro-hydraulic device for moving a jib of a luffing jib tower crane, comprising switching off the three-phase asynchronous motor when the position of the jib is not changed for a predefined time period, and switching on again the motor when an operating element for changing the vertical position of the jib, a lifting gear, or a slewing gear is actuated.

8. The method of claim 7, wherein the switching on step is carried out by an electronic soft starting unit operably connected to the motor.

* * * * *